US005582460A

United States Patent [19]

Schultz

[11] Patent Number: 5,582,460

[45] Date of Patent: Dec. 10, 1996

[54] PIVOTABLE AND HEIGHT-ADJUSTABLE CHAIR BACK REST ASSEMBLY AND BLOW-MOLDED BACK REST THEREFOR

[75] Inventor: Craig H. Schultz, Muscatine, Iowa

[73] Assignee: Hon Industries Inc., Muscatine, Iowa

[21] Appl. No.: 75,769

[22] Filed: Jun. 11, 1993

[51] Int. Cl.[6] ..... B60N 2/02

[52] U.S. Cl. ..... 297/353; 297/354.11; 297/452.36; 297/DIG. 2

[58] Field of Search ..... 297/297, 300, 297/306, 353, 354.11, 410, 452.29, 452.36, 452.65, DIG. 2

[56] References Cited

U.S. PATENT DOCUMENTS

| | | |
|---|---|---|
| D. 127,281 | 5/1941 | Schreckengost . |
| D. 261,831 | 11/1981 | Luckey . |
| D. 279,443 | 7/1985 | Diffrient . |
| 455,168 | 6/1891 | Case . |
| 2,030,635 | 2/1936 | Horwitt et al. . |
| 2,325,292 | 7/1943 | Westrope . |
| 2,549,902 | 4/1951 | Hibbard et al. . |
| 2,760,813 | 8/1956 | Colm . |
| 2,815,067 | 12/1957 | Richardson . |
| 3,142,194 | 7/1964 | Garden . |
| 3,215,470 | 11/1965 | Swenson et al. . |
| 3,271,073 | 9/1966 | Van Buren, Jr. . |
| 3,292,972 | 12/1966 | Krueger . |
| 3,427,054 | 2/1969 | Bergman . |
| 3,474,993 | 10/1969 | Murcott . |
| 3,614,156 | 10/1971 | Sarvas . |
| 3,669,496 | 6/1972 | Chisholm . |
| 3,669,499 | 6/1972 | Semplonius et al. . |
| 3,747,976 | 7/1973 | Lacey . |
| 3,904,242 | 9/1975 | Koepke et al. . |
| 4,012,158 | 3/1977 | Harper . |
| 4,036,525 | 7/1977 | Howk . |
| 4,043,592 | 8/1977 | Fries . |
| 4,153,296 | 5/1979 | Rhamstine . |
| 4,221,430 | 9/1980 | Frobose . |
| 4,227,102 | 7/1981 | Aaras et al. . |
| 4,267,748 | 5/1981 | Grunewald et al. . |
| 4,282,634 | 8/1981 | Krauss . |
| 4,401,006 | 8/1983 | Sekiguchi . |
| 4,451,084 | 5/1984 | Seeley . |
| 4,546,668 | 10/1985 | Mattsson . |
| 4,557,521 | 12/1985 | Lange . |
| 4,572,578 | 2/1986 | Perkins . |
| 4,573,737 | 3/1986 | Korn . |
| 4,616,877 | 10/1986 | Slaats et al. . |
| 4,647,109 | 3/1987 | Christophersen . |
| 4,659,135 | 4/1987 | Johnson . |
| 4,660,885 | 4/1987 | Suhr et al. . |

(List continued on next page.)

FOREIGN PATENT DOCUMENTS

| | | |
|---|---|---|
| 654651 | of 1929 | France . |
| 2505158 | of 1982 | France . |
| 160465 | of 1979 | Japan . |
| 196030 | of 1964 | Sweden . |

*Primary Examiner*—Laurie K. Cranmer
*Attorney, Agent, or Firm*—Jones, Day, Reavis & Pogue

[57] ABSTRACT

A chair is provided having a blow molded back rest and a mechanism which permits the back rest to pivot rearwardly and to be vertically adjusted. The mechanism has a carrier block slidably engaging vertical slots in a support member for vertical adjustment movement. The back rest is operatively attached to the carrier block so that the back rest can move in the vertical direction in unison with the carrier block or pivot rearwardly. The carrier block has a curved integral spring which engages the rear of the back rest to bias the back rest forward and to regulate the rearward pivoting motion as the user reclines. A handle and latch member are pivotably connected to the carrier block for movement between an engaged position in which a detent finger of the latch member acts as the stop latch or retainer which selectively engages a series of vertically spaced holes in the support member to secure the attached back rest and carrier block in the desired vertical position and a disengaged position in which the latch member and the handle are pivoted toward the front of the chair so that the detent finger is disengaged from the holes, thereby permitting the attached back rest and carrier block to be vertically adjusted.

24 Claims, 9 Drawing Sheets

U.S. PATENT DOCUMENTS 4,660,887 4/1987 Fleming et al. .
4,662,681 5/1987 Favaretto .
4,707,026 11/1987 Johansson .
4,744,603 5/1988 Knoblock .
4,828,323 5/1989 Brodersen et al. .
4,856,846 8/1989 Lohmeyer .
4,881,424 11/1989 Clark et al. .
4,892,356 1/1990 Pittman et al. .
4,908,917 3/1990 Kalie .
4,917,438 4/1990 Morgan .
4,961,610 10/1990 Reeder et al. .
5,007,678 4/1991 DeKraker .
5,009,467 4/1991 McCoy .
5,015,038 5/1991 Mrotz, III .
5,037,158 8/1991 Crawford ..... 297/353
5,143,422 9/1992 Althofer et al. .
5,232,265 8/1993 Estkowski et al. ..... 297/353

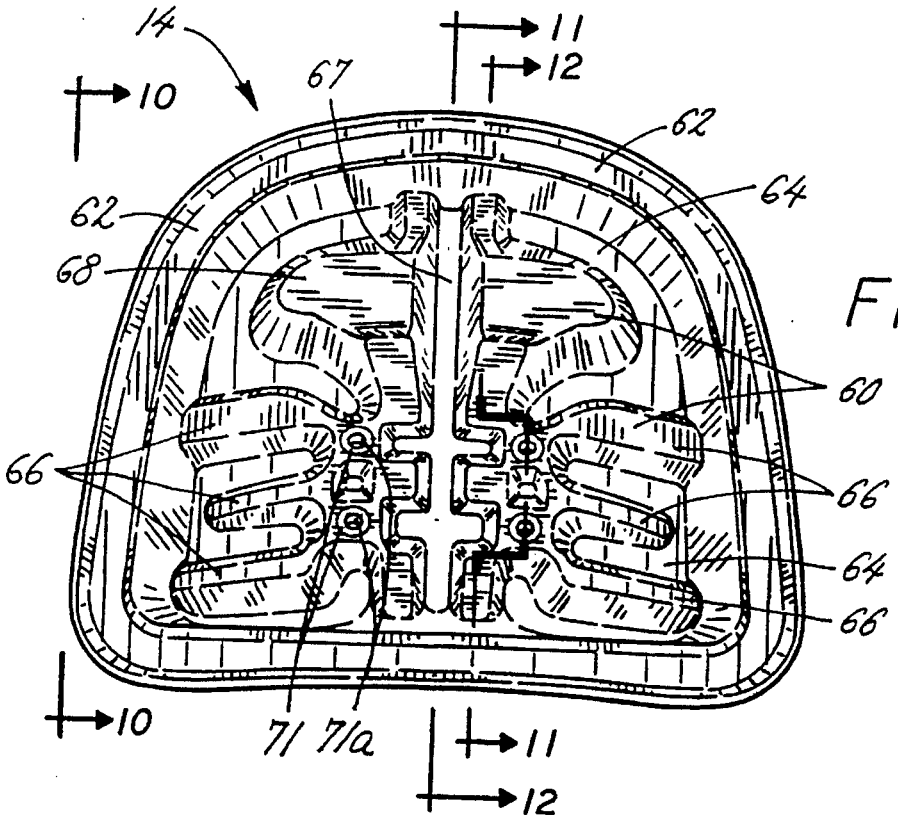
FIG. 9
FIG. 10
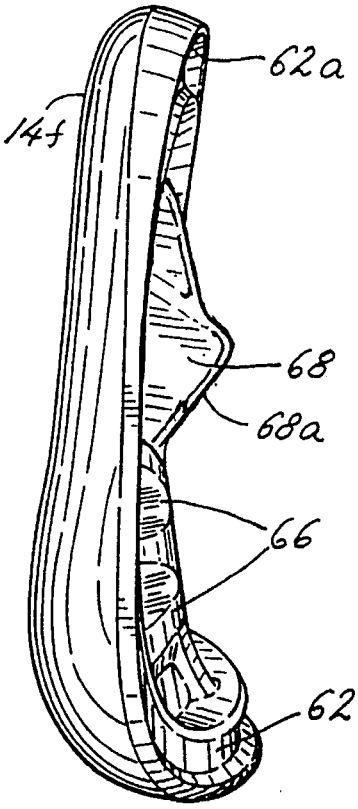
FIG. 11
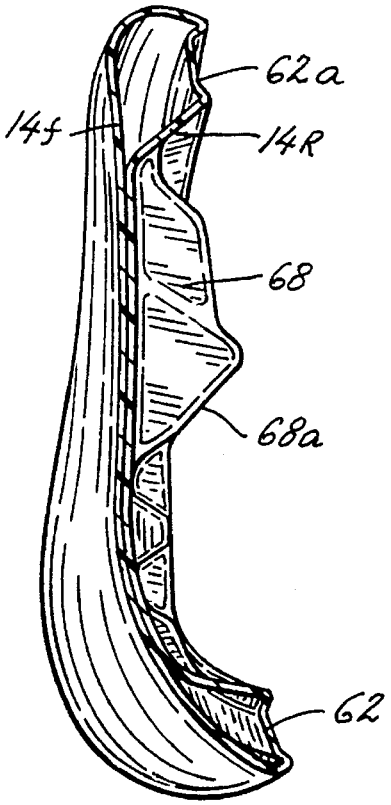
FIG. 12
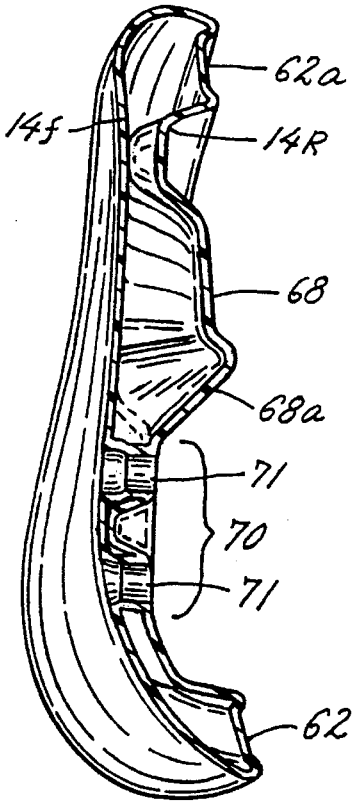

PIVOTABLE AND HEIGHT-ADJUSTABLE CHAIR BACK REST ASSEMBLY AND BLOW-MOLDED BACK REST THEREFOR

FIELD OF THE INVENTION

The present invention relates generally to chairs and, more particularly, to chairs having a height adjustable and tiltable back rest and to a blow molded back rest for such chair.

BACKGROUND OF THE INVENTION

Chairs have back rests which are typically intended to provide support for the user's back in the area between the shoulders and the waist. In order to accommodate the varying physical sizes of individual users, many chairs have a back rest that is vertically adjustable or tiltable relative to the chair seat. Unfortunately, typical height adjusting or tilting mechanisms have suffered from undue complexity, difficulty in assembly, unsightly appearance and difficulty in operation. Many such mechanisms have also required the user to operate them with both hands or have required the user to use tools to adjust the mechanism. Another deficiency with many back rest mechanisms is that the user is required to leave the chair in order to adjust the height of the back rest and then reoccupy the chair to determine whether the proper height has been attained.

Many typical back rests, especially unitary molded back rests, have lacked the ability to withstand the applied forces and thus have been subject to structural failure caused by stress-induced cracks resulting from flexing. The cushions used in these back rests have also been difficult and expensive to manufacture because they must be pre-formed in particular shapes and sizes to conform to the curvature of the human back.

OBJECTS AND SUMMARY OF THE INVENTION

It is an object of the present invention to provide an improved chair construction which has a back rest which may be vertically adjusted to accommodate different size users and which may be tiltable in order to conform to the curvature and orientation of the human back.

Another object of the present invention is to provide a chair having a back rest height and tilt adjustment mechanism which is easily and safely usable, is reliable in its operation and favorably supports the applied forces.

It is another object of the present invention to provide a back rest adjustment mechanism which can be easily adjusted while the user is seated in the chair.

It is another object of the present invention to provide a back rest adjustment mechanism which is relatively simple to assemble and easily manufactured.

Still another object of the present invention to provide an adjustment mechanism which is concealed to provide an aesthetically pleasing appearance, to prevent dust and dirt from collecting on the mechanism and interfering with its operation, and prevent the user from inadvertently touching the moving elements,.

Another object of the invention is to provide a unitary back rest which can easily and quickly be assembled with the support frame.

A further object of the present invention is to provide a back rest which is preformed to accommodate the curvature of a human back.

It is an object of the invention to provide a back rest which is relatively simple in its construction and inexpensive to manufacture.

It is another object of the invention to provide a back rest which affords comfort and supports proper ergonomic positions by the user.

Yet another object of the invention is to provide a back rest having a lightweight structure which can favorably withstand the applied forces.

The present invention is generally directed to a chair having a back rest and a mounting mechanism which permits the back rest to pivot rearwardly and to be vertically adjusted. The mounting mechanism comprises a carrier or slide block which slidably engages a support member for vertical movement. The back rest is operatively attached to the carrier block so that the back rest can move in the vertical direction in unison with the carrier block and pivot rearwardly relative thereto. The carrier block preferably has a curved integral spring means which engages the rear of the back rest to bias the back rest forward and to regulate the rearward pivoting motion as the user reclines.

In an exemplary embodiment, the carrier block is attached to a support plate which is attached to the vertical support posts found in many typical chairs. The plate has a plurality of vertical slots which slidably receive the carrier block and a series of vertically spaced horizontal latch holes for holding the back rest in any of a variety of desired vertical positions by selective latching employment of a spring-loaded activator handle and latch member. The handle and the latch member are pivotably connected to the carrier block for movement between engaged and disengaged positions. In the engaged position, a detent finger of the latch member acts as the stop latch or retainer which selectively engages the holes to secure the attached back rest and carrier block in the desired vertical position. In the disengaged position, the latch member and the handle are pivoted toward the front of the chair so that the detent finger is disengaged from the holes, thereby permitting the attached back rest and carrier block to be vertically adjusted.

In a preferred embodiment, the latch member also has an integral resilient member which biases the handle and the detent finger rearwardly into latching engagement with the holes in the support plate, thereby securing the back rest in the desired vertical position. The detent finger is disengaged from the holes in the plate when the activator handle is positioned forward toward the front of the chair, thereby allowing the carrier block and attached back rest to be vertically positioned.

The back rest is a blow-molded integral member having front and rear walls which form a plurality of hollow, thin walled, integral rib sections defining an essentially rigid frame and a central cavity area, with some portions of the front and back walls contacting and thereby joined to one another in this central cavity area. The front wall of the chair back (the user side) is contoured to conform to the curvature of a human back to provide ergonomic support for the user. The upper portion is slightly concave which accommodates the curvature of the upper portion of the back and shoulders and gradually blends into the bottom portion which is slightly convex which accommodates the curvature of the lumbar portion of the back.

The walls form a hollow wall section extending around the periphery of the back rest and define the central cavity, a plurality of hollow rib sections and a mounting section adapted to attach to the mounting mechanism. The individual rib sections are formed in the rear wall and are separated by recesses which correspond to the portions of the front and rear walls that are joined together. A vertically extending recess disposed in the center of the back rest separates the back rest into a left and right sides. The rib sections and the recesses provide structural support and transfer the loads and stresses exerted on the chair back by a user to the mounting mechanism. The ribs and recesses serve to stiffen the back rest and resist the lateral flexing or bending movement of the user's back and also serve to reinforce the back rest in response to the torsional forces and stresses exerted on the back rest when the user tilts the back rest rearwardly, especially the central mounting section which is directly attached to the mounting mechanism.

In an exemplary embodiment, the left and right sides are mirror images having three pairs of generally horizontal ribs disposed in the lower portion of the back rest, a pair of larger rib sections at the top, and a center mounting section which connects the horizontal ribs and the top ribs. The mounting section has a plurality of holes which are adapted to attach the back rest and the mounting mechanism together.

The back rest is adapted for ready application of a rigid cover shell or other cover finishes, such as fabric or other upholstery, which may be secured by stapling or other suitable attachment means around the rear peripheral edge. In an exemplary embodiment, the rear side of the back rest is covered by a rear or intermediate shell which provides a rear finished surface over most of the back rest in a generally known manner. The rear shell is formed with a cavity in its lower central portion for accommodating therein the entire height adjusting and tilting mechanism. The mounting of the vertical adjusting and tilting mechanism to the rear chair support and within the cavity also effects securement of the back rest and shell to one another. A rear shell filler piece is attached by snap-acting clips to close the cavity and thereby cover the mounting mechanism and provide a finished rear surface while also providing ready access to the mounting and adjusting mechanism.

These and other features and advantages of the invention will be more readily apparent upon reading the following description of embodiments of the invention and upon reference to the accompanying drawings wherein:

BRIEF DESCRIPTION OF THE DRAWINGS

FIG. 9 is a rear perspective view of the blow molded back rest of FIG. 1 without the rear cover;

FIG. 10 a side view of the blow molded back rest of FIG. 1 without the rear cover;

FIG. 11 is a cross-sectional view of the back rest taken along line 11—11 in FIG. 9; and FIG. 12 is a cross-sectional view of the back vent taken along line 12 in FIG. 9.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
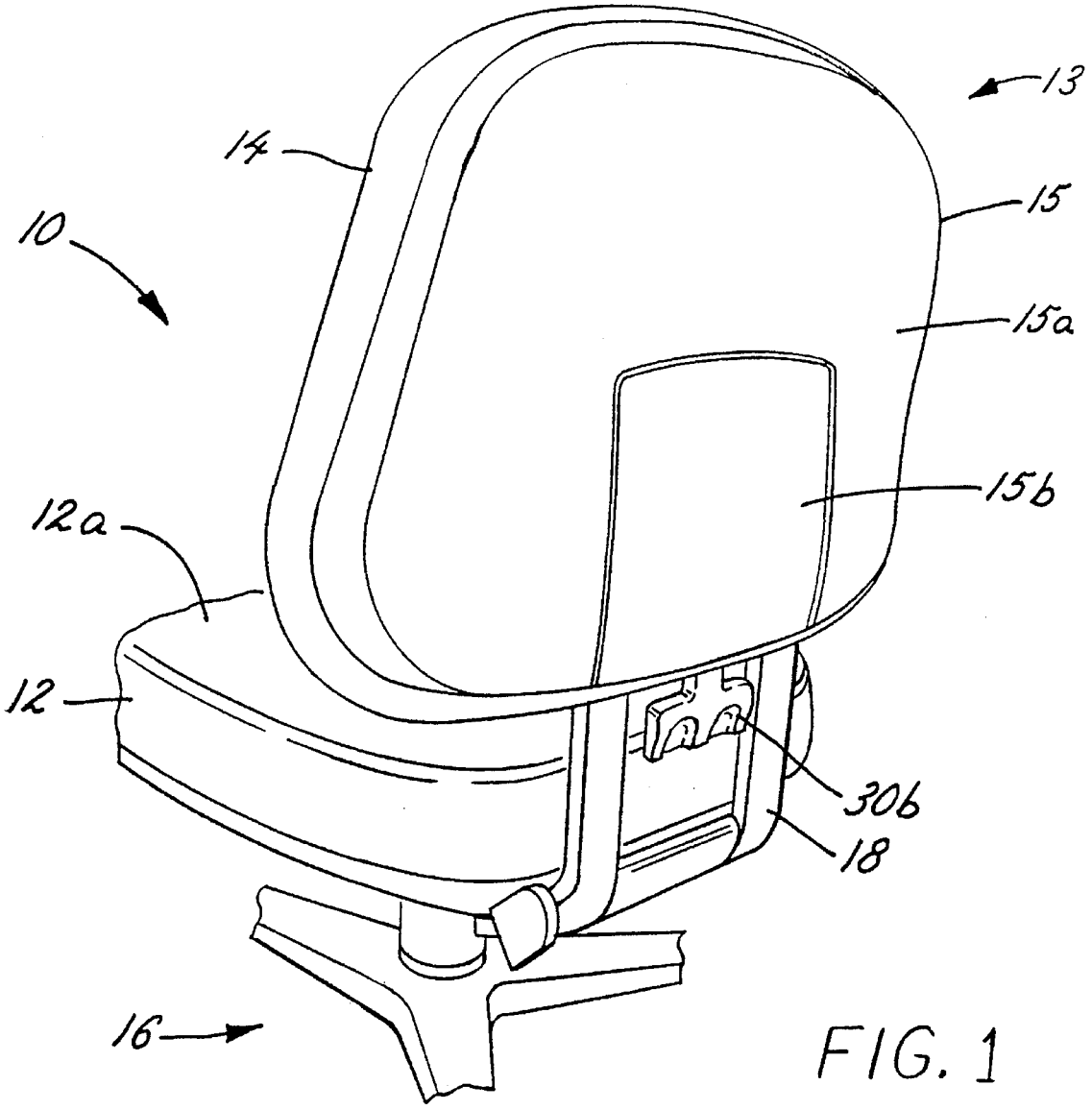
FIG. 1 is perspective view of a portion of a chair showing a chair seat and a back rest (with a rear cover) in accordance with a preferred embodiment employing teachings of the present invention.

Referring to FIG. 1, there is shown a perspective view of part of a chair 10 including a chair seat 12 and one embodiment of a height-adjustable and tiltable back rest assembly 13 in accordance with the present invention. In order to simplify the figures, the chair legs and the chair arms have not been shown. One embodiment of the chair arms which may be used in cooperation with the chair 10 is illustrated in my copending applications entitled Adjustable Width Arm Rest, Ser. No. 08/073,678, filed Jun. 8, 1993, and Detachable Chair Arm, Ser. No. 08/073,717, filed Jun. 8, 1993, which are incorporated herein by reference. The chair seat 12 has a generally horizontal top surface 12*a* to permit a user to sit thereon. A leg assembly, generally depicted at 16, supports the chair seat 12 and the back rest assembly 13 comprising a back rest 14 and a rear cover 15. The back rest assembly 13 is typically supported by a support member 18 which, in the illustrated embodiment, is in the form of two vertical support posts which may be attached to the underside of the seat 12 or to the leg assebmly 16. Those skilled in the art will appreciate that the support member 18 may include other structures including, for example, a plate, a single post or the like.

In accordance with certain objects of the invention, the back rest 14 is operatively connected to the support member 18 by the height adjustment and tilting or mounting mechanism 20 so that the back rest 14 may be selectively adjusted to accommodate different sizes and/or positions of users. The mounting mechanism 20 permits the vertical height of the back rest 14 to be selectively adjusted and the back rest 14 to be resiliently tilted rearwardly.

An exemplary embodiment of the mechanism 20 is illustrated in FIG. 2. It comprises a slide or carrier block 22 which is adapted to pivotably support the back rest 14 so that the back rest 14 may be adjusted vertically in unison with the carrier block 22 while also being tiltable, about a horizontal axis, against a resilient restoring restraint. A support plate 24 is adapted to slidably support the carrier block 22 and the attached back rest 14 for the vertical adjustment movement. A latch member 26 is supported on the block 22 and adapted for selective latching engagement with a plurality of latch or detent openings 28 in the support plate 24 in order to hold the back rest 14 in a selected vertical position. An activator handle 30 is adapted to selectively disengage the latch member 26 from the detent openings 28 and permit the carrier block 22 and the back rest 14 to be vertically adjusted.

The support plate 24 is adapted to be rigidly attached to the support posts 18 so as to have sufficient structural strength and integrity to withstand the forces exerted thereon when the user leans on the back rest 14. In the illustrated embodiment, the support plate 24 is welded to the support posts 18, but other methods to rigidly attach the support plate 24 and the support posts 18 will be known to those skilled in the art including, for example, screws, bolts and the like. The support plate 24 may also be integrally formed with the support posts 18.

A plurality of vertically-spaced horizontal detent openings 28 and vertical elongated slots 32 are disposed in the middle portion of the support plate 24 located between the spaced support posts 18. The vertical slots 32 are adapted to slidably mount the carrier block 22 on plate 24 in a manner to permit the carrier block 22 (and the attached back rest 14) to be vertically positioned over a vertical interval corresponding generally to the dimension between the top and bottom ends of the slots 32. The slots 32 permit the back rest 14 to have a vertical movement of preferably about 2¼ inches, which has been found to meet most ergonomic needs.

The detent openings 28 are adapted to selectively receive the latch member 26 therein in order to hold the carrier block 22 and the attached back rest 14 in the selected vertical position. In practice, it has been found that having 7 openings and spacing each detent opening 28 at about ⅜ inch increments apart so as to yield a 2¼ inch range of vertical motion for the back rest 14 will meet most ergonomic needs.

Figure 2A:
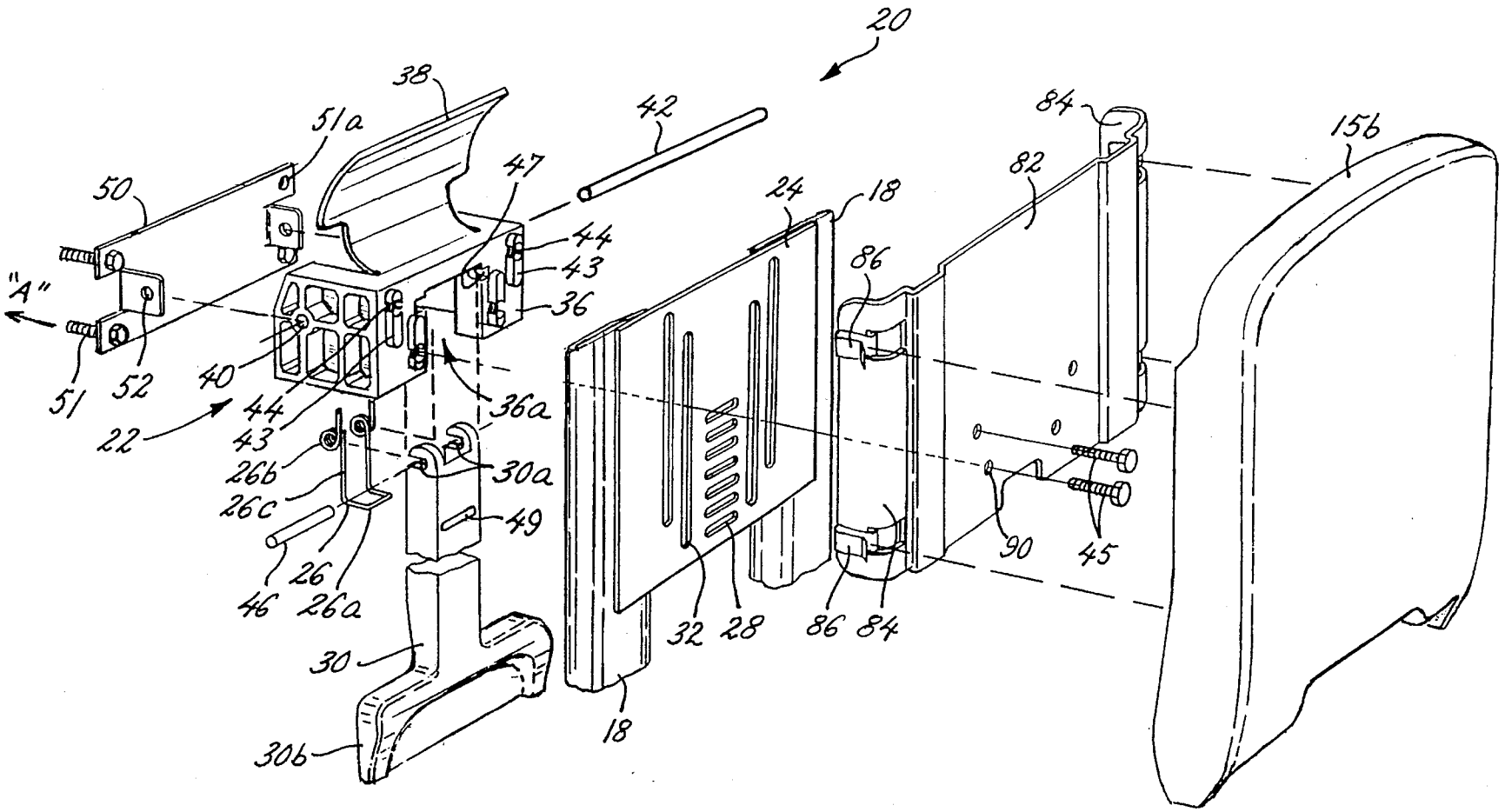
FIGS 2A and 2B are exploded perspective views showing the components of the height adjusting and tilting mechanism and the cover for the back rest of FIG. 1.
Figure 4:
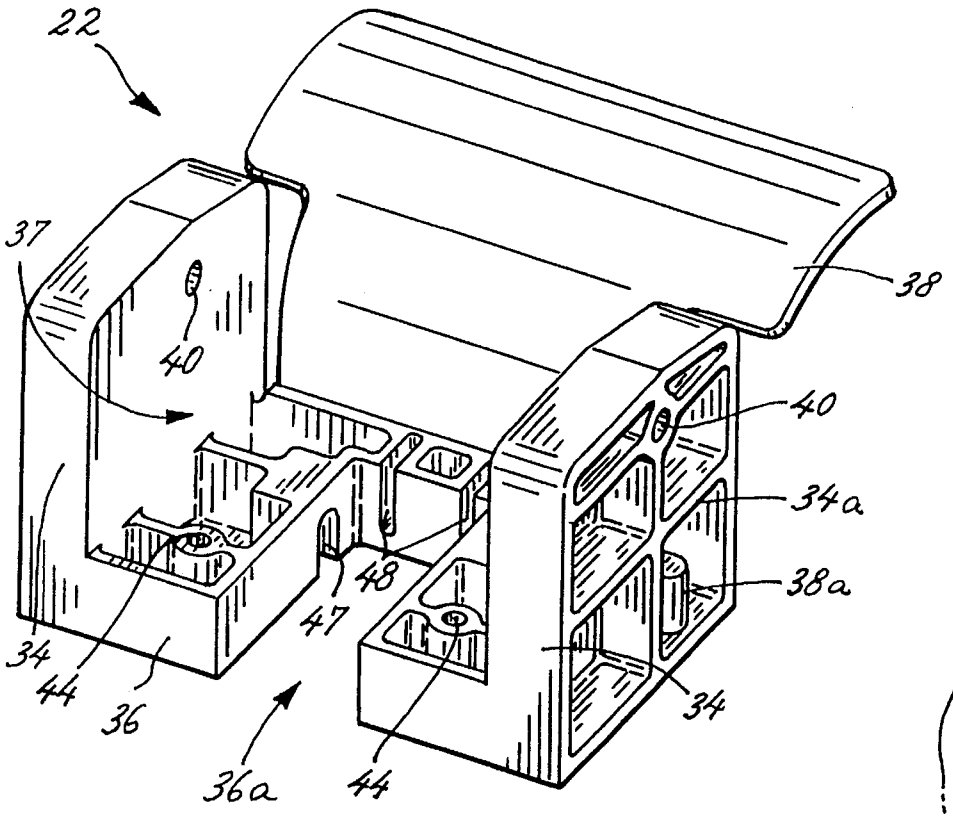
FIG. 4 is a perspective view of the carrier block.

Two perspective views of the carrier block 22 are illustrated in FIGS. 2A and 4. FIG. 2A illustrates a perspective view of the rear, top and one end of the carrier block 22 and FIG. 4 illustrates a perspective view of its underside and interior cavity. It will be seen that the carrier block 22 has a cavity 37 generally defined by two opposing side walls 34, a rear wall 36 and resilient member 38 projecting from the top of the rear wall 36. In order to provide a lightweight but structurally strong carrier block 22, the walls 34 of the carrier block 22 may have a plurality of reinforcing ribs 34*a* as will be seen upon reference to FIGS. 2A and 4. The side walls 34 have respective holes 40 which cooperate with pin 42 to pivotally mount the back rest 14 on the block 22 for tilting movement about the axis of the pin 42 against the resilient positioning restraint of resilient element 38 which is referred to further below. It will be appreciated that the back rest 14, which is attached to the carrier block 22, will move vertically in unison with the carrier block 22.

In order to permit the carrier block 22 to slidably engage the support member 24 and to support the back rest 14, a plurality of vertically elongated slide protuberances 43 project from the rear surface of the rear wall 36 (to the right in FIG. 2) so as to slidably engage the vertical slots 32 in the support plate 24 and permit the carrier block 22 to be positioned between the top and bottom ends of the slots 32. The protuberances 43 should have sufficient structural strength to withstand the forces and stresses which will be exerted thereon by the user and back rest 14 and to prevent the carrier block 22 from inadvertently escaping from the vertical slots 32 due to such forces. The carrier block 22 has a plurality of holes 44 which align with the slots 32 and cooperate with a plurality of corresponding screws 45 or the like to slidably secure the carrier block 22 and the support plate 24 together. To this end, the protuberances 43 preferably are of a height, as measured normal to the front face plane of the carrier 22, which is slightly greater than the thickness of the support plate 24. This provides secure mounting of the carrier 22 and attached back rest 14 while affording ready vertical adjustment movement after the screws 45 are secured through a clamp or mounting plate slide 82 on the rear side of the support plate 24. Other methods to slidably attach the carrier block 22 to the support plate 24 and to the back rest 14 will be known to those skilled in the art.

Figure 3:
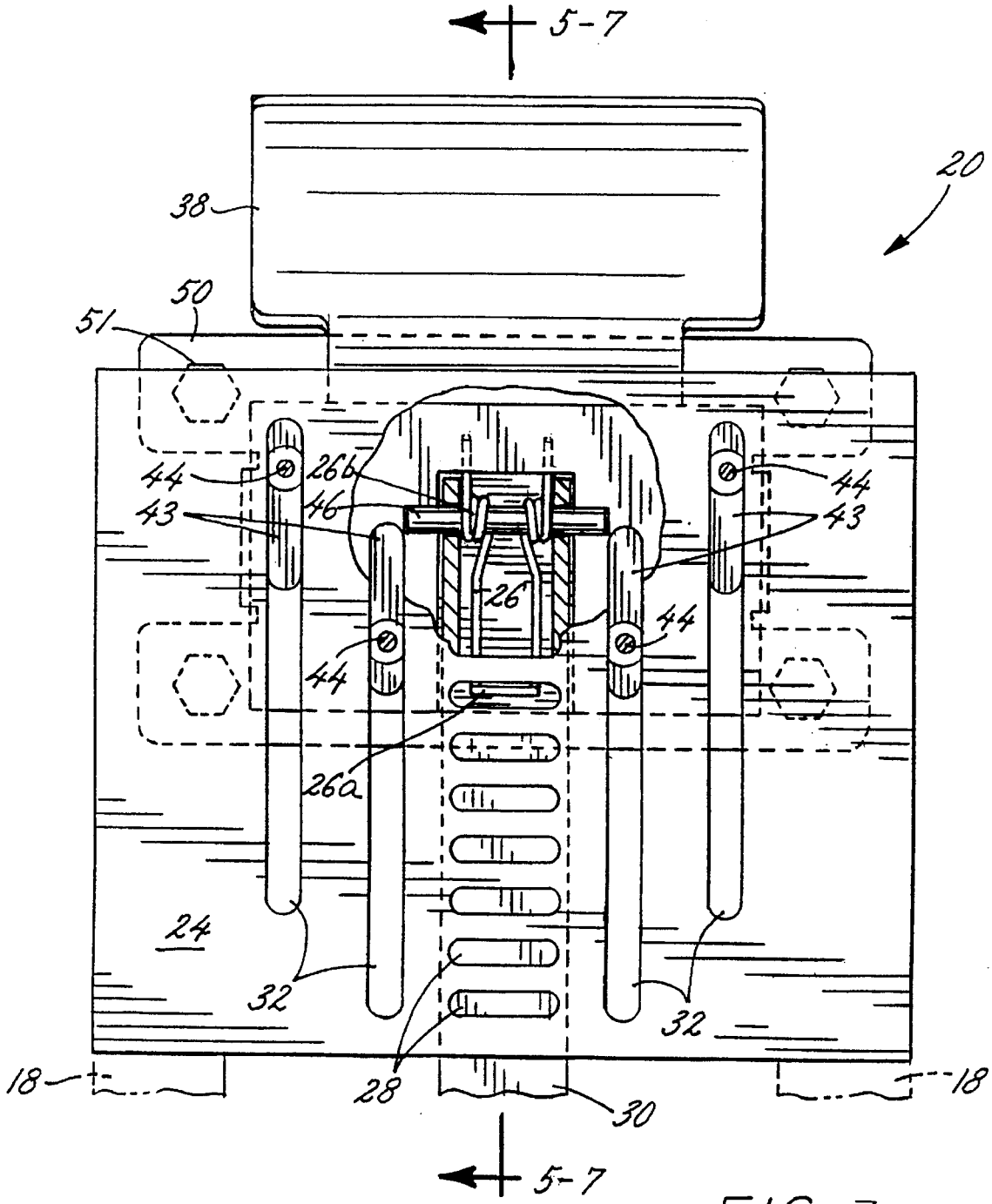
FIG. 3 is a rear view of the height adjusting and tilting mechanism for the back rest showing the detent engaging the latch or detent openings to hold the back rest in a desired vertical position.
Figure 5:
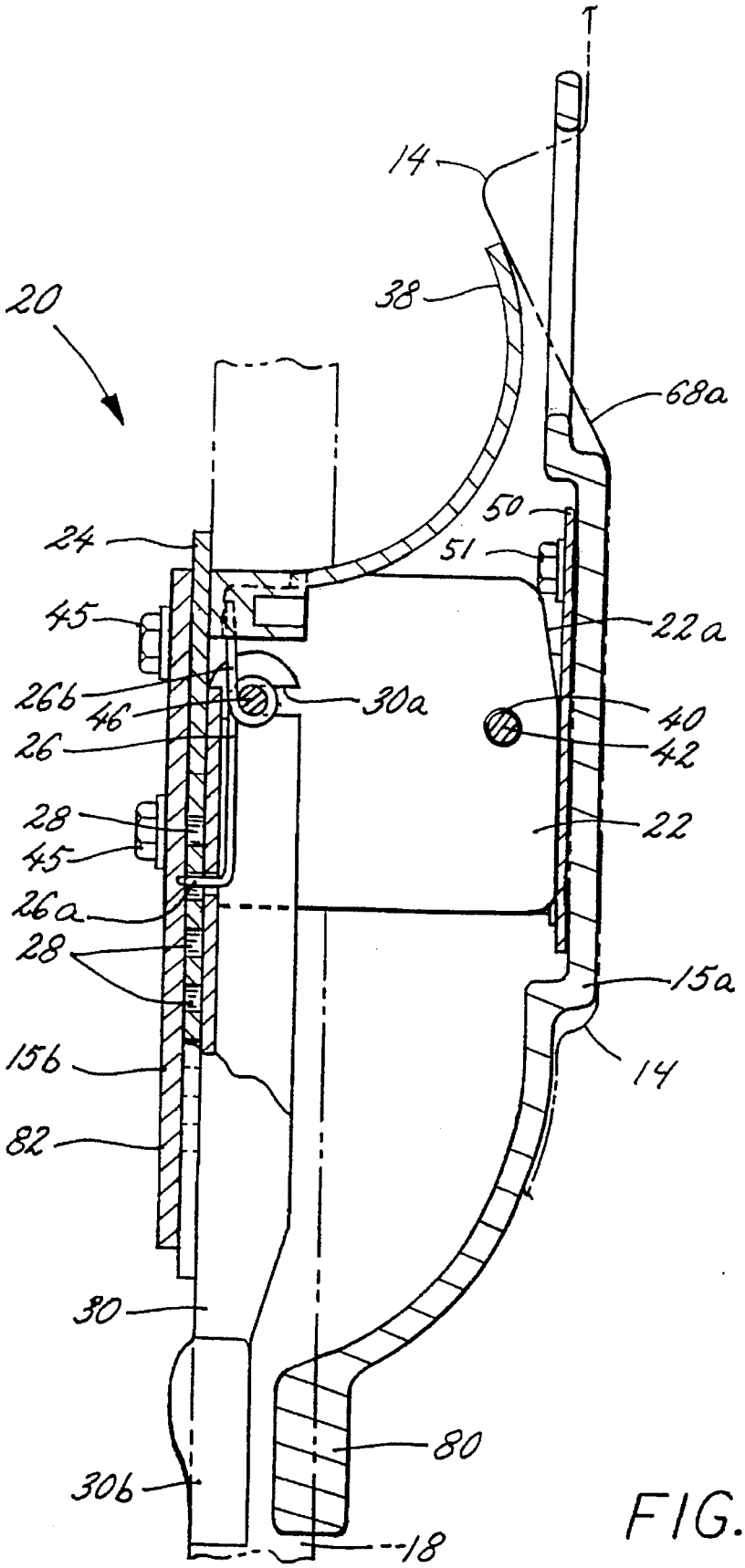
FIG. 5 is a cross sectional view of the back rest, the main cover, and the height adjusting and tilting mechanism for the back rest taken along line 5—5 in FIG. 3 and showing the back rest and handle in a vertical position and the detent engaging the detent openings to hold the back rest in a desired position.
Figure 6:
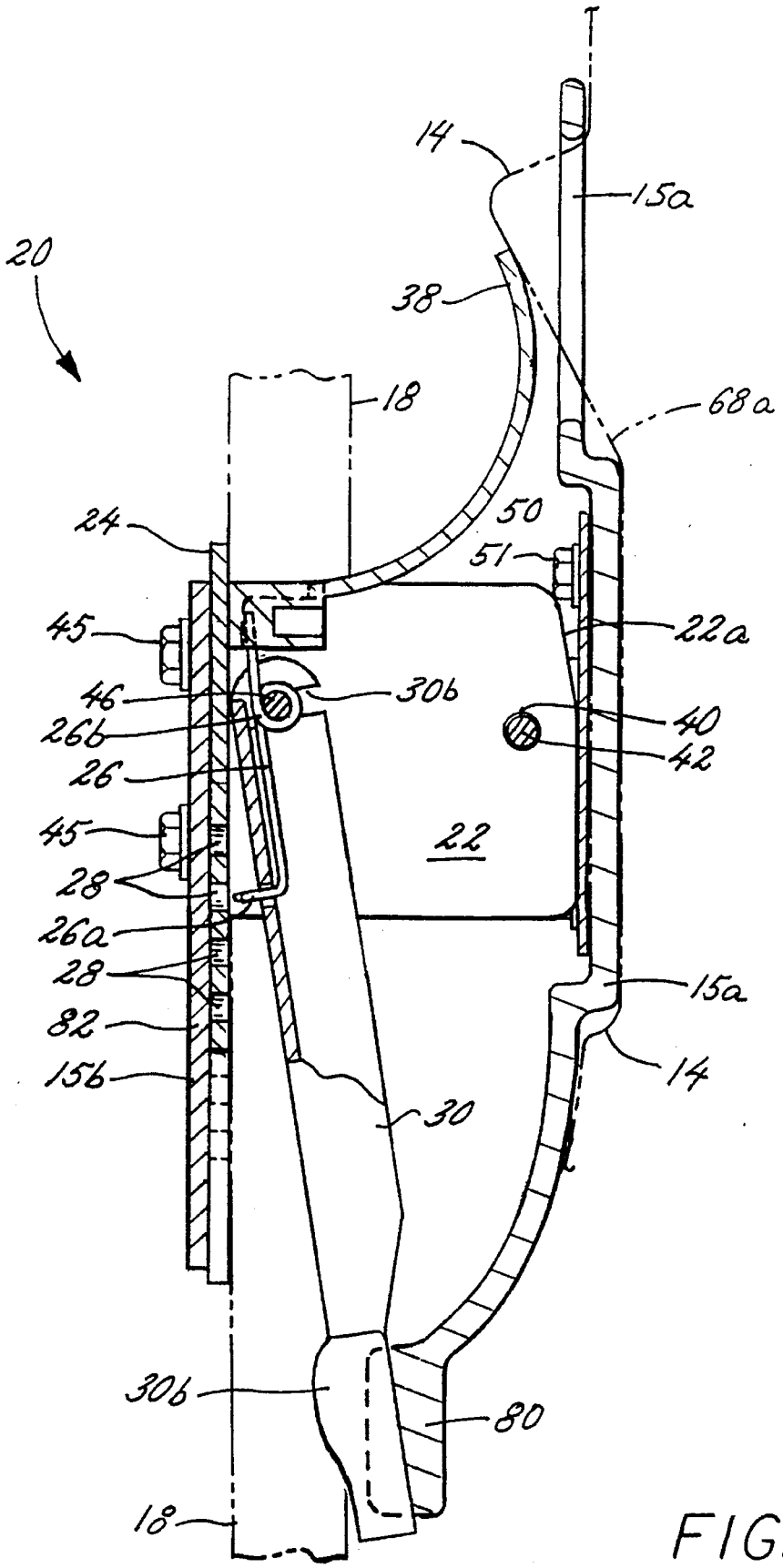
FIG. 6 is a cross sectional view as in FIG. 5 and showing the handle and latch member pivoted forwardly (to the right) so as to disengage the detent from the detent openings and permit the back rest to be vertically adjusted.
Figure 7:
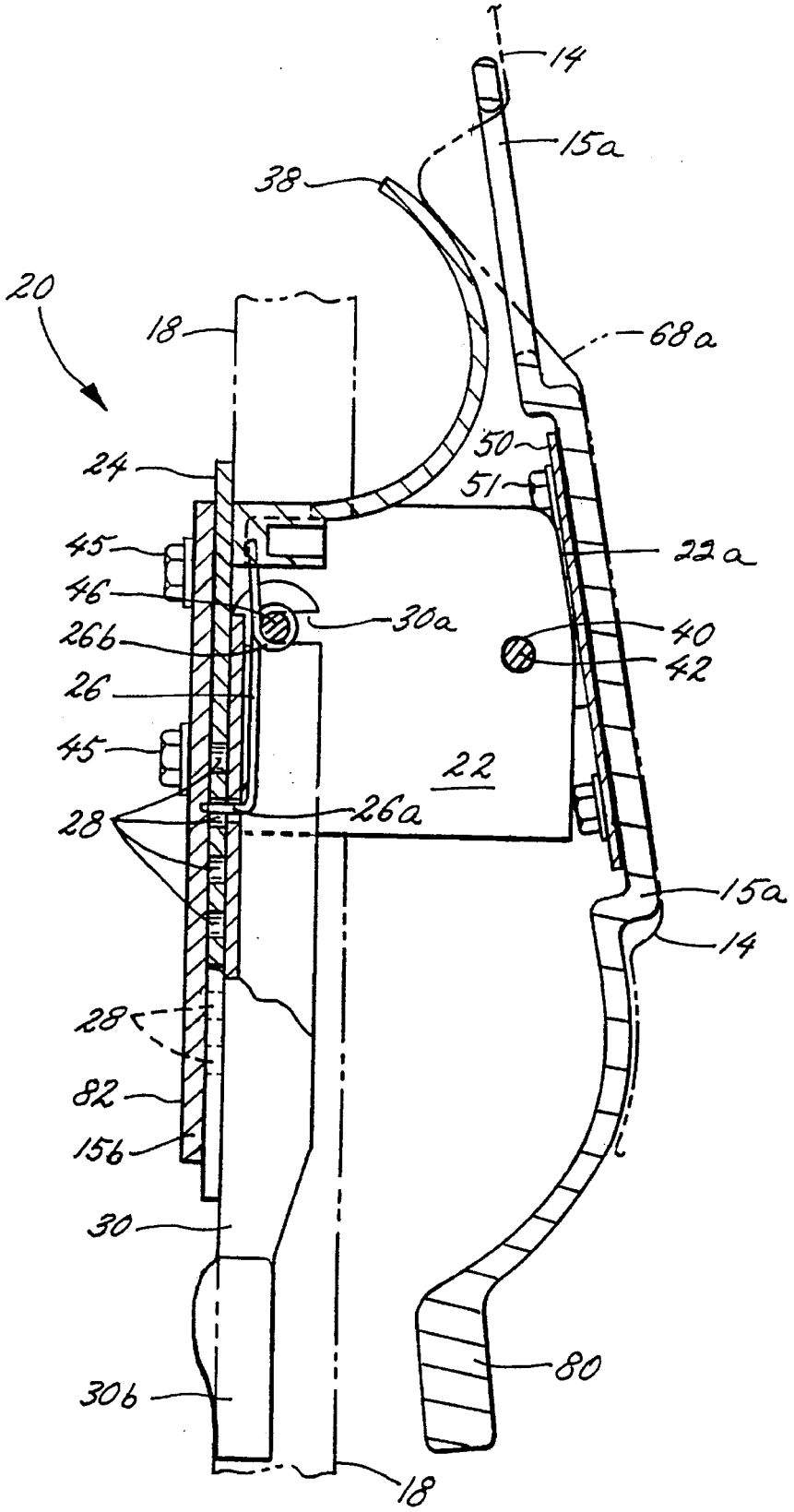
FIG. 7 is a cross sectional view as in FIG, 5 and showing the back rest and the main cover tilted rearwardly (to the left)

The rear wall 36 has a channel generally depicted as 36*a* adapted to pivotally receive the latch member 26 and handle 30 therein. A slot 47 is disposed in the walls of the channel 36*a* so as to permit the pin 46 to be slidably inserted laterally therein. The pin 46 and slot 47 cooperate to pivotally support the latch member 26 and the activator handle 30. The pin 46 permits the latch member 26 and the handle 30 to pivot about the axis of the pin 46 between an engaged position as shown in FIGS. 3, 5 and 7 and a disengaged or inclined position as shown in FIG. 6. In the engaged position, the latch member 26 engages one of the detent openings 28 so as to hold the carrier block 22 in the desired vertical position and prevent the carrier block 22 from sliding movement within the slots 32. In the disengaged position, the latch member 26 is disengaged from the detent openings 28, thereby permitting the attached carrier block 22 and back rest 14 to be adjusted to the desired height.

The latch member 26 has a protruding detent finger 26*a* which acts as a stop latch or retainer to selectively engage the openings 28 for positively securing the attached carrier block 20 and back rest 14 in the desired vertical position. The handle 30 permits the user to selectively disengage the latch member 26 so that the vertical position of the carrier block 22 and the attached back rest 14 can be adjusted. The mechanism 20 may also have a resilient member to bias the latch member 26 into latching engagement with the detent openings 28.

In the illustrated embodiment, the latch member 26 has a generally L-shaped cross section defined by an integrally formed detent finger 26*a*, resilient member 26*b*, and an arm/lever 26*c*. The detent 26*a* projects from the arm 26*c* and is adapted to latchedly engage the detent openings 28 in the support plate 24. The resilient member 26*b* includes a pair of coil springs. The coil springs 26*b* are adapted to receive the pin 46 therein so that the pin 46 supports the latch member 26 in the channel 36*a* of the carrier block 22 and permits the latch member 26 to pivot about the pin axis between the engaged position (shown in FIGS. 3, 5 and 7) and the disengaged position (shown in FIG. 6). The stub ends of the springs 26*b* are adapted to engage slots 48 of the carrier block 22 as best shown in FIG. 4. Referring to FIG. 5, it will be seen that the slots 48 provide a surface which permits the springs 26*b* to bias the latch member 26 and handle rearwardly to the engaged position.

In the illustrated embodiment of the activator handle 30, the upper end of the handle 30 has notches 30*a* adapted to receive the pin 46 laterally thereinto, thereby enabling the handle 30 to be pivotally attached to the carrier block 22 for movement about the pin axis between the first or vertical position in FIGS. 3, 5 and 7, and a second, inclined position in FIG. 6. The other end of the handle 30 has a relatively large handle portion 30*b* exposed below the bottom of the back rest 14, preferably such that a user can readily grasp the handle portion and pull the handle forwardly while seated in the chair 10 and without having to leave the chair 10. The handle 30 also has an opening 49 disposed between the two ends which permits the detent 26*a* of the latch member 26 to protrude through and to engage the detent openings 28 in the support plate 24 as best illustrated in FIGS. 3, 5 and 7.

In the engaged position, the spring section 26*b* biases the detent finger 26*a* rearwardly (to the left in FIG. 5) so that it protrudes through the hole 49 in the handle 30 and engages within the holes 28 in the plate 24 as shown in FIGS. 3, 5 and 7, thereby securing the back rest 14 in the desired vertical position. By pulling the activator handle 30 forward (to the right in FIG. 6), the detent 26*a* is disengaged from the holes 28 in the plate 24 (as shown in FIG. 6), thereby allowing the carrier block 22 and attached back rest 14 to be vertically positioned. After the handle 30 is released, the spring 26*b* will bias both the handle 30 and the detent finger 26*a* rearwardly into latching engagement in the detent openings 28.

The back rest 14 and the carrier block 22 are attached to each other to permit the back rest 14 to move in unison with the carrier block 22 and permit the vertical position of the back rest 14 to be adjusted. A back bracket 50 is rigidly attached to the back rest 14 by a plurality of screws, bolts 51 or the like in cooperation with holes 51*a*. The back bracket 50 may be attached directly to the back rest 14 or a rear cover 15 may be disposed intermediate the bracket 50 and back rest 14 as illustrated in FIGS. 2B and 5–7. The back bracket 50 has holes 52 which cooperate with pin 42 to attach the back rest 14 to the carrier block 22. Once the back rest 14 is attached to the carrier block 22 by pin 42, the back rest 14 may move in the vertical direction in unison with the block 22 and it may tilt about the pin axis between a first, vertical position as shown in FIGS. 5, 6 and a second inclined position as shown in FIG. 7. Thus, the back rest 14 may be tilted rearwardly to an inclined position in response to movement of the user.

Referring to FIGS. 5–7, it will be seen that the carrier block 22 has an integral, arcuate-shaped resilient member 38 which abuts the rear surface of the back rest 14 and yieldably biases the back rest 14 forwardly to its upright position, thereby controlling the rearward tilting movement of the back rest 14. The forward end (to the right in FIG. 7) of the carrier block 22 has an inclined portion 22*a* which both accommodates and limits the rearward movement of the back rest 14 as shown in FIG. 7. It has been found that rearward inclination of the back rest 14 of about 12° will meet most ergonomic needs of the user. It will be appreciated that the back rest 14 should not be permitted to incline so far rearwardly that the chair 16 and user would cause the chair 10 to become less stable fall or that the resilient element 38 would be overstressed. Thus, the maximum rearward inclination of the back rest 14 will be limited by the particular design of the chair 10.

In accordance with certain objects of the invention, a blow molded back rest 14 is provided. The back rest 14 is shown in an upholstered finished condition and with a rear cover in FIG. 1, and without the rear cover or the upholstery in FIGS. 2, 9–11. The back rest 14 preferably is formed through a conventional blow molding process which forms no part of this invention. Any material may be used which is compatible with the blow molding process and which is resilient but which nevertheless provides a firm support and frame for the user's back. In a preferred embodiment, the wall thickness may vary from about 0.03 to about 0.1 inches but may be varied to provide the necessary support for the back rest 14.

The back rest 14 has front and rear walls 14F, 14B forming a hollow, thin walled, integral, essentially rigid frame, with some portions of the front and back walls 14F, 14B contacting and thereby integrally joined to one another in the molding process and the remainder spaced from one another. It is preferred that all of the open interior spaces be in internal communication with one another so as to simplify the blow molding process.

Figure 8:
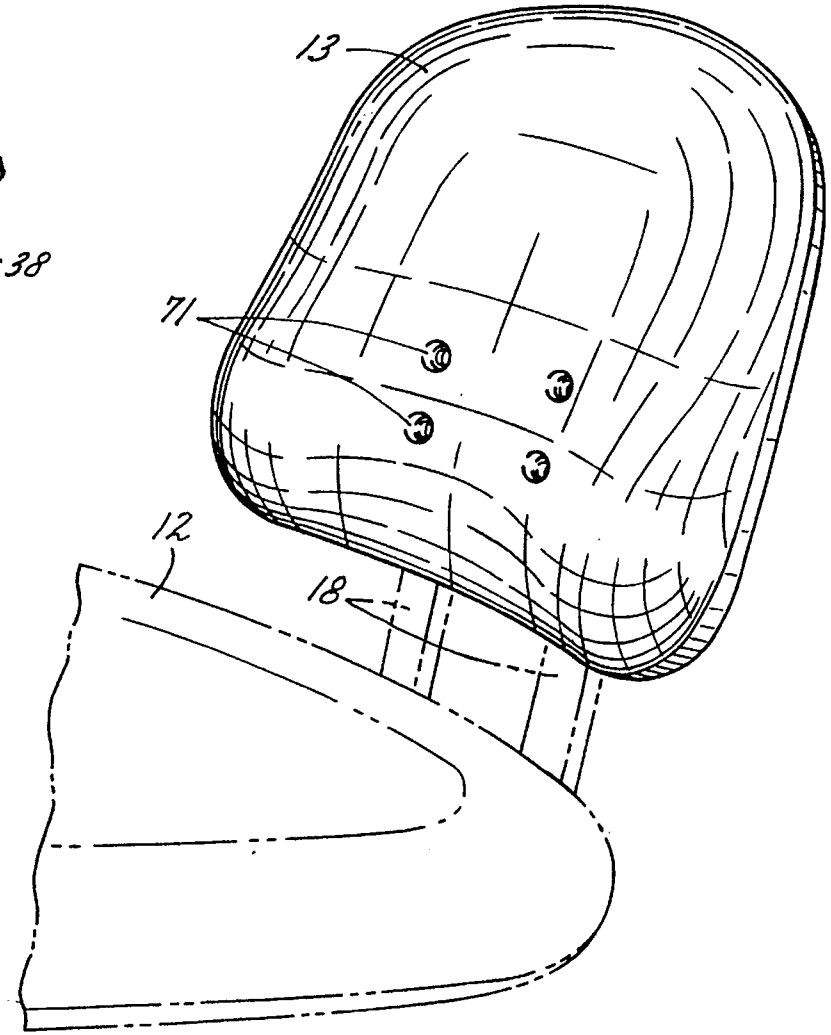
FIG. 8 is a front perspective view of the blow molded back rest of FIG. 1, as mounted on a chair which is shown in part in dashed lines.

Referring to FIGS. 8 and 11–12, the front wall 14F of the back rest (the user side) is contoured to conform to the curvature of a human back for providing proper ergonomic support for the user. The upper portion is slightly concave which accommodates the curvature of the upper portion of the back and shoulders and gradually blends into the bottom portion which is slightly convex which accommodates the curvature of the lumbar portion of the back. The bottom portion of the back rest 14 is slightly wider than the upper portion.

The back or rearward wall 14R of the back rest 14 has a plurality of hollow rib channel sections 60 disposed in the center of the back rest 14 and a hollow wall section 62 extending around the periphery of the back rest 14. The wall section 62 has a recess 62*a* in its rear surface for receiving staples and excess upholstery. Referring to FIGS. 9 and 11–12, it will be seen that the individual rib sections 60 are separated by recessed areas 64 which are the portions of the front and rear walls 14F, 14R that are or may be joined together. The recessed areas 64 between the ribs 60 are approximately 1–1½ inches wide. A vertically extending recess 67 disposed in the center of the back rest 14 separates the back rest 14 into left and right sides which are substantially mirror images of each other.

In the illustrated embodiment, the left and right sides have three pairs of generally horizontal ribs 66 disposed in the lower portion of the back rest 14, a pair of generally vertical larger lobar ribs 68 extending to the top, and a center mounting section generally depicted at 70 which connects the horizontal ribs 66 and the top ribs 68. Referring to FIGS. 5–7 and 11, it will be seen that the top ribs 68 each has an inclined face 68*a*, preferably about 150°, adapted to engage the integral resilient member 38 of the carrier block 22. The mounting section 70 has a generally planar rear surface and a plurality of holes 71 which are adapted to attach the back rest 14 and the height adjustment mechanism 20 together. It is preferable that each of the holes 71 have threaded metal grommet elements mounted directly therein to serve as anchors for the attachment bolts. As previously described, the mounting mechanism 20 may be directly attached to the back rest 14 or a rear cover 15 may be interposed therebetween.

The ribs 60 and recesses 64 extend laterally from the median recess 67 and provide structural support and transfer the loads and stresses exerted on the back rest 14 by a user to the mounting mechanism 20. The ribs serve to stiffen the back rest 14 and resist the lateral flexing or bending movement of the user's back. They also serve to reinforce the back rest 14 in response to the torsional forces and stresses exerted on the back rest 14 when the user tilts the back rest rearwardly, especially the center section 70 which is directly attached to the mounting mechanism 20.

In order to cover the rear of the back rest 14 and present an aesthetically pleasing appearance, the back rest may have a rear cover 15. The cover 15 will also prevent dust and dirt from collecting on the mechanism and interfering with its operation. In the illustrated embodiment, the rear cover 15 comprises a two piece construction including a main cover 15*a* and a smaller mounting or insert cover 15*b*. The main cover 15*a* is a molded shell which has an outer peripheral wall adapted to engage the periphery of the rear wall 14R of the back rest 14 outboard of the upholstery securement channel 62*a*. A centrally located cavity 72 includes a U-shaped perimeter wall portion 72*a* and an inner floor wall 72*b* which includes a planar mounting portion 72*c* for mating abutment with section 70 of the back rest and for receiving the back bracket 50. The cavity 72 is adapted to receive the mounting mechanism 20 and the insert cover 15*b*. The insert cover 15*b* fits within, and closes the central cavity 72, covering the mounting mechanism 20. Thereupon, the cover 15 forms a substantially smooth surface, as seen in FIG. 1.

Figure 2B:
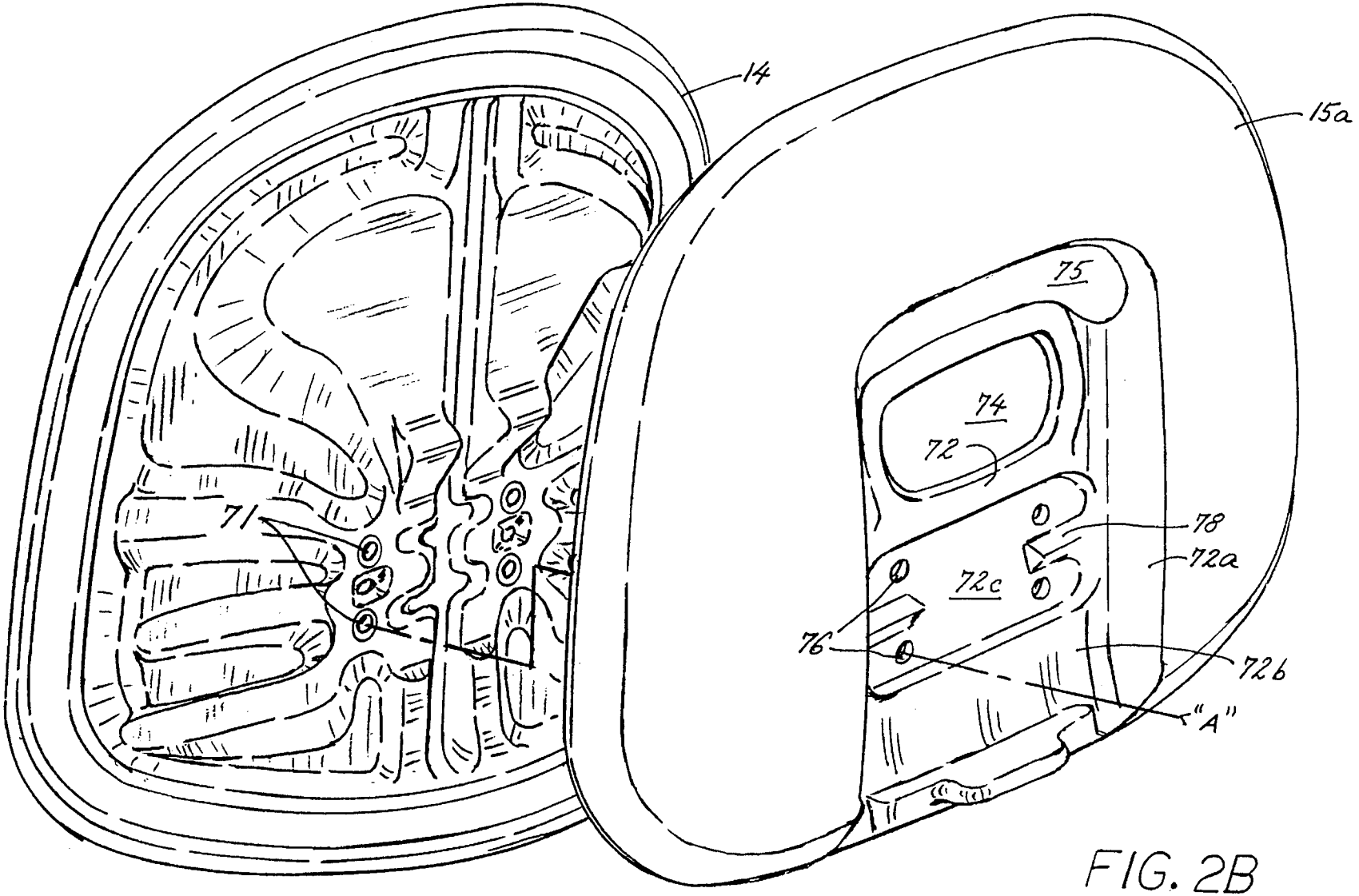

Referring to FIGS. 2A and 2B, it will be seen that the main cover 15*a* is adapted to be disposed intermediate the back rest 14 and the mounting mechanism 20 so as to be captured therebetween and be mounted to the back rest 14. The central cavity 72 has an opening 74 which permits the larger ribs 68 of the back rest 14 to protrude through and engage the resilient member 38 of the carrier block 22 as shown in FIGS. 5–7. An upper opening 75 receives the upper peripheral edge of the insert cover 15*b* when the attached back rest 14 and main cover 15*a* are tilted rearwardly by the user. A plurality of holes 76 are disposed in the cavity 72 and cooperate with the back rest holes 71, the back bracket holes 53*a*, and the attachment bolts 51 to attach the back rest 14, the back bracket 50 and the main cover 15*a* together. The central cavity 72 has spaced ribs 78 adapted to capture the pin 42 therebetween and prevent the pin 42 from inadvertently escaping the back bracket 50 and the carrier block 22. Another rib 80 protrudes from the lower end of the central cavity 72 in order to limit the forward movement of the handle 30 as best illustrated in FIG. 6. The rib 80 also acts to prevent the user's fingers from inadvertently catching between the handle 30 and the cover 15.

An insert mounting plate 82 is provided. Referring to FIG. 2A, it will be seen that the mounting plate 82 has a planar surface adapted to engage the protuberances 38 and the support plate 24 to provide stable sliding support of the mechanism 20 on the plate 24. In the illustrated embodiment, projecting side walls 84 are adapted to receive a plurality of mounting clips 86. The insert cover 15*b* may be attached to the mounting plate 82 by press fitting the sides of the insert cover 15*b* into the mounting clips 86, but other methods will be known to those skilled in the art. If insert cover 15*b* is not used, a smaller flat plate (not shown) may be used so as to act as an anchor element for the attachment bolts. It will be appreciated that the clips 86 provide easy assembly and disassembly of the cover 15*b* for covering and gaining access to the mounting mechanism 20. The insert mounting plate 82 has a plurality of holes 90 corresponding to the carrier holes 44 to receive the bolts 45 which attach the entire assembly directly to the carrier block 22. Since the back rest 14, the main cover 15*a* and the insert cover 15*b* all are attached to the carrier block 22, it will be appreciated that they will move in unison with each other and, thereby, minimize any gaps therebetween.

A foam cushion and/or upholstery covering may cover the back rest 14 and/or the rear cover 15. The cushion may be applied to the front of the back rest shell by any conventional molding technique. It will also be appreciated that since the back rest 14 is preformed to ergonomically accommodate the curvature and shape of the user, the cushion may have a substantially uniform thickness, unlike many typical chairs in which the foam must be preformed in separate pieces having varying thickness and shapes to accommodate the ergonomic shape of the user. The cushion and upholstery fabric together mask the frame of the back rest 14, and provide a smooth, resilient comfortable surface. The foam cushion is sufficiently thick and possesses enough resiliency to provide a comfortable support on the front surface. A typical cushion material will be made of polyurethane and be about 1½ inches thick although other materials will be known to those skilled in the art.

The padding or cushion is placed adjacent the front face 14F of the back rest 14 and the upholstery is wrapped around the back rest 14 so that it extends around the periphery of the back rest 14 and may be secured to the rear side by staples, glue or the like. The recess 62*a* around the periphery of the back rest 14 accommodates the staples and excess fabric to yield a smooth and consistent product. The back rest material should be sufficiently rigid and dense so as to hold the staples properly.

The mounting mechanism 20 and the rear cover 15 may be positioned on the back rest 14 once the cushion and upholstery is attached to the back rest 14 and the rear cover 15. The main cover 15*a* is placed adjacent the rear side of the back rest 14 so that the holes 71 and 76 are aligned and so that the inclined faces of the larger ribs 68 protrude through the center opening 74 in the main cover 15*a*.

The carrier block 22 is pivotally attached to the back bracket 50 by aligning the holes 40 and 52 and inserting the pin 42 therein. The attached back bracket 50 and carrier block 22 are then mounted to the central cavity 72 of the main cover 15*a* by aligning the holes 51*a*, 71 and 76 and inserting attachment bolts 51 therein. It will now be appreciated that the back rest 14 and the rear cover 15*a* are rigidly connected together by the bolts 51 and the pin 54 is captured between the cavity ribs 78 so as to prevent the pin 42 from inadvertently escaping from the back bracket 50 and the carrier block 22.

The spring latch member 26, pin 46 and handle 30 are readily assembled in the mechanism 20 by placing the pin 46 through the coils of the member 26 and then pressing this subassembly laterally onto the handle 30 with protruding portions of the pin 46 being moved laterally into the slots 30*a* and with the detent finger 26*a* extending through the slot 40. The handle 30 is then positioned with the lower end 30*b* outward as the upper end carrying the pin 46 and latch springs 26*b* are inserted into the carrier 22 and the ends of the pin 46 are inserted laterally into the slots 47. The handle 30 then is rotated downward about the axis of the pin 46, which pivots the stub ends of the spring coils 26*b* into the slots 48. While the parts are retained in this position, the subassembly is placed against and secured to the support plate 24 so that the protuberances 43 of the carrier block 22 slidably engage in the vertical slots 32 of the support plate 24. In this position, the subassembly is captured between the rear wall 36 of the carrier block 22 and the support plate 24 which thereafter maintains the assembly in its operative correlation. It will also be appreciated that the detent 26*a* latchedly engages the detent openings 28. After the mounting plate 82 is disposed adjacent the support plate 24, the bolts 45 may be used to secure the carrier block 22 and the support plate 24. The sides of the insert cover 15*b* slidably engage the clips 86 for securement thereto.

It should now be appreciated that the back rest 14 will be held in a vertical position as a result of the latching engagement between the detent finger 26*a* and the detent openings 28. In order to adjust the vertical height of the back rest 14, the user positions the handle 30 forwardly so that the handle 30 disengages the detent finger 26*a* from the detent openings 28. The user may then slide the back rest 14 to the desired vertical position between the upper and lower ends of the vertical slots 32. At the desired vertical position, the user releases the handle 30 wherein the spring 26*b* biases the detent finger 26*a* and the handle 30 rearwardly so that the detent finger 26*a* reengages one of the detent openings 28, and thereby latchably secures the back rest 14 in the desired vertical position.

The back rest 14 can pivot about an axis passing through the pin 42 between a vertical and an inclined position. The integral spring 38 of the carrier block 22 engages the inclined face 68*a* of the ribs 68 and the back rest 14 so that it biases the back rest 14 forwardly, thereby permitting yieldable rearward tilting of the back rest 14 to conform to the user's comfort and support.

Thus, it will be seen that a blow molded back rest and a height adjusting and tilting mechanism and related chair structures have been provided which attain the aforenoted objects. Various additional modifications of the described embodiments of the invention specifically illustrated and described herein will be apparent to those skilled in this art, particularly in light of the teachings of this invention.

I claim as my invention:

1. A height adjusting support mechanism for a back rest of a chair, said mechanism comprising:

a support plate having a plurality of vertical slots, a carrier slidably attached to said support plate by engagement through said vertical slots for vertical movement relative to said plate and operatively attached to a back rest so that said back rest moves with said carrier in the vertical direction, and selectively interengageable latch components joined to said support plate and said carrier for retaining said carrier in various vertical positions relative to said support plate, wherein said carrier pivotally supports said back rest for movement between a substantially vertical position and an inclined position.

2. A mechanism as in claim 1 comprising a spring member engaging said back rest for biasing said back rest to the vertical position.

3. A mechanism as in claim 2 wherein said spring member is integrally formed with said carrier.

4. A mechanism as in claim 3 wherein said spring member is defined by an arcuate shaped resilient member projecting from said carrier.

5. A mechanism as in claim 1 wherein said latch components comprise a latch member pivotally attached to one of said carrier and said support plate for pivotal movement about a first axis between an engaged position in which said latch member engages the other of said carrier and said support plate to hold said back rest in the desired vertical position and a disengaged position in which said latch member is disengaged from the other of said carrier and said support plate to permit said back rest to be vertically adjusted.

6. A mechanism as in claim 5 including a spring member for biasing said latch member into said engaged position, and a handle for disengaging said latch member in said disengaged position.

7. A mechanism as in claim 6 wherein said spring member is integrally formed with said latch member.

8. A mechanism as in claim 7 wherein said latch member comprises an integrally formed detent portion for selective latching engagement with said other of said carrier and said support plate in the engaged position.

9. A mechanism as in claim 8 wherein said support plate comprises a plurality of detent openings for receiving said detent portion of said latch member in the engaged position, and said latch member is pivotally attached to said carrier for movement between an engaged position in which said detent portion engages said detent openings to hold said back rest in the desired vertical position and a disengaged position in which said detent portion is disengaged from said detent openings to permit said back rest to be vertically adjusted.

10. A mechanism as in claim 9 wherein said handle is pivotally attached to said carrier and is disposed between said latch member and said support plate.

11. A mechanism as in claim 1 wherein said latch member and handle are pivotally attached to said carrier for rotation about the same axis.

12. A mechanism as in claim 11 wherein said carrier comprises a rear wall and spaced opposing side walls for receiving said latch member and said handle therebetween, two of said walls have a slot therein, and a pin pivotally received in said slot, said latch member and handle being mounted on said pin.

13. A height adjusting support mechanism for a tiltable back rest of a chair, said mechanism comprising:

a support member, a carrier member attached to said support member for vertical movement relative thereto, said carrier member pivotally supporting a back rest for tilting movement about a generally horizontal axis and such that said back rest moves with said carrier in the vertical direction, said carrier member including a resilient cantilever component which is integral with said carrier member and protrudes upwardly thereof and abuts said back rest above said horizontal axis and resiliently biases said back rest to an upright position while permitting rearward tilting thereof about said horizontal axis, and selectively interengageable latch components joined to said support member and said carrier member for retaining said carrier member in various vertical positions relative to said support member.

14. The mechanism as shown in claim 13 wherein said cantilever component is defined by an arcuate shaped spring member projecting from said carrier member.

15. The mechanism as shown in claim 14 wherein said latch components comprise a latch member pivotally attached to one of said carrier member and said support member for pivotal movement about a first axis between an engaged position in which said latch member engages the other of said carrier member and said support member to hold said back rest in the desired vertical position and a disengaged position in which said latch member is disengaged from the other of said carrier member and said support member to permit said back rest to be vertically adjusted.

16. A mechanism as in claim 15 including a spring member for biasing said latch member into said engaged position, and a handle for disengaging said latch member in said disengaged position.

17. The mechanism as shown in claim 15 wherein said latch member and handle are pivotally attached to said carrier for rotation about the same axis.

18. A chair comprising a height adjusting mechanism, a blow-molded back rest and a substantially vertical support member, said back rest comprising an integral blow molded frame formed by front and rear walls joined to one another at their peripheries and defining a central cavity area therewithin, a plurality of alternating ribs and recesses disposed along said rear wall for structurally reinforcing said back rest, wherein said ribs are hollow and said front wall has a contoured front surface for supporting a back of a user, said mechanism comprising a carrier member slidably attached to said support member and operatively attached to said back rest so that said back rest moves in unison with said carrier member in the vertical direction, and selectively interengageable latch components joined to said support member and said carrier member for retaining said carrier member in various vertical positions relative to said support member, said back rest being pivotally attached to said carrier member for movement between a substantially vertical position and an inclined position.

19. A chair as in claim 18 comprising a spring member integrally formed with said carrier member and engaging said back rest for biasing said back rest to the vertical position.

20. A chair as in claim 18 wherein said latch components comprise a latch member pivotally attached to one of said carrier member and said support member for pivotal movement about a first axis between an engaged position in which said latch member engages the other of said carrier member and said support member to hold said back rest in the desired vertical position and a disengaged position in which said latch member is disengaged from the other of said carrier member and said support member to permit said back rest to be vertically adjusted.

21. A chair as in claim 20 including a spring member for biasing said latch member into said engaged position, and a handle for disengaging said latch member in said disengaged position.

22. A chair as in claim 21 wherein said latch member and handle are pivotally attached to said carrier for rotation about the same axis.

23. A chair as in claim 18 comprising a rear cover mounted intermediate said rear wall of said back rest and said height adjusting mechanism.

24. A chair comprising a height adjusting mechanism, a blow-molded back rest and a substantially vertical support member, said back rest comprising an integral blow molded frame formed by front and rear walls joined to one another at their peripheries and defining a central cavity area therewithin, a plurality of alternating ribs and recesses disposed along said rear wall for structurally reinforcing said back rest, wherein said ribs are hollow and said front wall has a contoured front surface for supporting a back of a user, said mechanism comprising a carrier member slidably attached to said support member and operatively attached to said back rest so that said back rest moves in unison with said carrier member in the vertical direction, and selectively interengageable latch components joined to said support member and said carrier member for retaining said carrier member in various vertical positions relative to said support member, said latch components comprising a latch member pivotally attached to one of said carrier member and said support member for pivotal movement about a first axis between an engaged position in which said latch member engages the other of said carrier member and said support member to hold said back rest in the desired vertical position and a disengaged position in which said latch member is disengaged from the other of said carrier member and said support member to permit said back rest to be vertically adjusted, wherein said back rest is pivotally attached to said carrier member for movement between a substantially vertical position and an inclined position, and a spring member integrally formed with said carrier member and engaging said back rest for biasing said back rest to the vertical position.

* * * * *